United States Patent [19]

Horie et al.

[11] Patent Number: 4,823,715

[45] Date of Patent: Apr. 25, 1989

[54] FEED CONTROL APPARATUS FOR A SEWING MACHINE

[75] Inventors: Fujio Horie; Mitsuyasu Kyuno, both of Nagoya, Japan

[73] Assignee: Brother Kogyo Kabushiki Kaisha, Aichi, Japan

[21] Appl. No.: 82,600

[22] Filed: Aug. 7, 1987

[30] Foreign Application Priority Data

Aug. 8, 1986 [JP] Japan ..... 61-187200

[51] Int. Cl.[4] ..... D05B 3/02

[52] U.S. Cl. ..... 112/315; 112/314; 112/456

[58] Field of Search ..... 112/455, 456, 314, 323, 112/315

[56] References Cited

U.S. PATENT DOCUMENTS

| | | | |
|---|---|---|---|
| 4,271,773 | 6/1981 | Makabe et al. | 112/453 |
| 4,308,814 | 2/1982 | Takenoya | 112/455 |
| 4,315,472 | 6/1982 | Makabe et al. | 112/453 |
| 4,368,683 | 1/1983 | Takenoya | 112/314 |
| 4,696,247 | 9/1987 | Horie | 112/456 |

FOREIGN PATENT DOCUMENTS 57-30026 2/1982 Japan .

*Primary Examiner*—Andrew M. Falik

*Attorney, Agent, or Firm*—Barnes & Thornburg

[57] ABSTRACT

In order to correct the asynchronous state of a feed pulse motor of a sewing machine used to reciprocate a feed for feeding a fabric to a sewing needle, a feed control apparatus is provided which switches the pulse motor to a predetermined excited state when the feed dog abuts a stopper on the downstream side of feed motion at the start up of sewing operation so as to locate the feed dog at a known reference position. Additionally, the feed control apparatus switches the pulse motor to another predetermined excited state when the feed dog abuts a stopper on the upstream side of the feed motion so as to locate the feed dog at a known position during consecutive sewing operation.

7 Claims, 12 Drawing Sheets

FEED CONTROL APPARATUS FOR A SEWING MACHINE

BACKGROUND OF THE INVENTION

The present invention relates to a feed control apparatus of a fabric feed device which drives directly a feed dog by a pulse motor controlled by open loop control system.

Conventionally, fabric feed devices for sewing machines obtain horizontal feeding motion of the feed dog by converting rotation of a main motor with a large torque into swinging motion. A converting mechanism for providing this swinging motion is constituted of a large number of parts such as a cam and a forked link, therefore a defect can result when a stitch pattern gets out of shape due to accumulated errors in the feed motion to be transmitted. Also, the conventional feed devices require a large space for installation in the bed of the sewing machine, resulting in a hindrance in making the sewing machine lighter and smaller.

Then, to eliminate the above-mentioned defect, an apparatus which drives a feed dog using a pulse motor as an independent driving source of the main motor is proposed and disclosed in the Japanese Patent Publication (examined) No. 57-30026. This apparatus detects each phase of rotation of an upper shaft and directly drives a pulse motor by an open loop control system in synchronism with the phase detection signal, thereby freely controlling feed motion of work fabric.

Control of the pulse motor by the open loop control system is performed by commanding the rotary angle of the pulse motor with reference to the number of steps or unit rotating motion. Accordingly, in operating the sewing machine, the pulse motor is set to an original or reference position once, and thereafter the number of command pulses is controlled assuming that the pulse motor is rotating in accurate response to the command pulses.

However, in a feed device employing a small-sized pulse motor with a small torque, an overload is applied to the feed dog due to forced feeding when starting the sewing machine or due to transfer of a thick part of work fabric, and thereby the pulse motor sometimes falls into step-out so as to be out of sync with respect to the reference position (loss of synchronism). If the pulse motor falls out of synchronism with respect to an initial reference position once, despite the fact that the relation between the rotary position of the pulse motor and the number of commanded steps is out of order, a controller gives command pulses assuming that the pulse motor is in synchronous state, and the feed dog is permitted to move within a predetermined range of horizontal feed motion and, therefore after the feed dog has reached the limit position and stopped, only the excited state of the pulse motor is changed and the pulse motor remains out of synchronism.

For this reason, once the pulse motor, which is out of sync due to overloading remains out of sync during continued operation. even after removal of the overload, and cannot give an accurate amount of horizontal feeding motion to the feed dog, therefore there remains a defect that the stitch pattern gets out of shape.

To prevent the above-described step-out non-synchronization of the pulse motor with respect to a reference position, a method is proposed wherein the overload to be applied to the feed dog is applied to the pulse motor through an escape spring without applying it directly to the pulse motor. However, in such a method, the pulse motor is required to rotate against a maximum tension of the spring without stepping-out. For this purpose, the maximum tension of the spring is required to be smaller than the step-out torque of the pulse motor. However, reduction in the spring constant means that the feed dog does not synchronize easily with the rotation of the pulse motor by a small external force, resulting in deterioration of the stitch pattern, and also means that the torque of the pulse motor is not used fully as a feeding force. Also, an increase in the step-out torque makes the pulse motor larger in size, raising a problem in weight and mounting.

In order to eliminate this defect, as described in U.S. Pat. No. 4,696,247, one of the inventors of the present invention proposed a feed device including a stopper disposed at a stoppage position corresponding to at least one of an upstream limit position and a downstream limit position of the horizontal feed motion of a feed dog. A feed control, having a excitation control, switches the excitation mode of a stepping motor which draws the feed dog to a specific excitation mode at least at the start and the end of the horizontal feed motion.

In the above-noted feed device, the stepping motor can be resynchronized to a reference position at the start-up of the sewing machine and during sewing operation. However, in the case where the asynchronous state of the stepping motor is induced by forceably feeding the fabric at the start-up of the sewing machine, feeding motion is carried out in the asynchronous state until the feed dot arrives at the downstream stoppage position. Therefore, the feed device cannot feed the fabric accurately.

Also in the case where the asynchronous state is induced by the feeding resistance due to a thick part of the fabric, feed motion is carried out in the asynchronous state until the feed dog arrives at the downstream stoppage point.

In order to solve the above-noted problems, at the start-up of the sewing machine, and after correcting an asynchronous state of the stepping motor, feeding motion should be carried out. Similarly, during sewing operation, after correcting an asynchronous state of the stepping motor at both the start or the end of the feed motion, continued feeding motion should be carried out. However, this patient publication does not disclose such a technical concept.

SUMMARY OF THE INVENTION

One object of the present invention is to provide a feed control apparatus which automatically performs recovery from step-out state when the pulse motor, due to over load at the start-up of sewing operation and/or during consecutive sewing operation, is no longer synchronized with a reference position.

Another object of the present invention is to provide a feed control apparatus which permits use of a small-sized low torque pulse motor for feed motion.

In a sewing machine having a feed device driven with a pulse motor for feeding a fabric from an upstream location to a downstream location, a feed control apparatus according to the present invention comprises: a first stopper and a second stopper for defining an upstream side limit position and a downstream side limit position, respectively, in order to define the range of horizontal feed motion of a feed dog; first excitation control means to excite the pulse motor into a first predetermined excited state at the start or the end of feed motion when the feed dog is stopped at the first limit position; second excitation control means to excite the pulse motor into a second predetermined excited state at the end of feed motion when the feed dog is stopped at the second limit position; and sequence setting means for moving the feed dog to the second limit position in order to make the second excitation control means operative at the start-up of sewing operation, and for moving the feed dog to the first limit position in order to make the first excitation control means operative during subsequent sewing operation.

DESCRIPTION OF THE PREFERRED EMBODIMENTS

Figure 1:
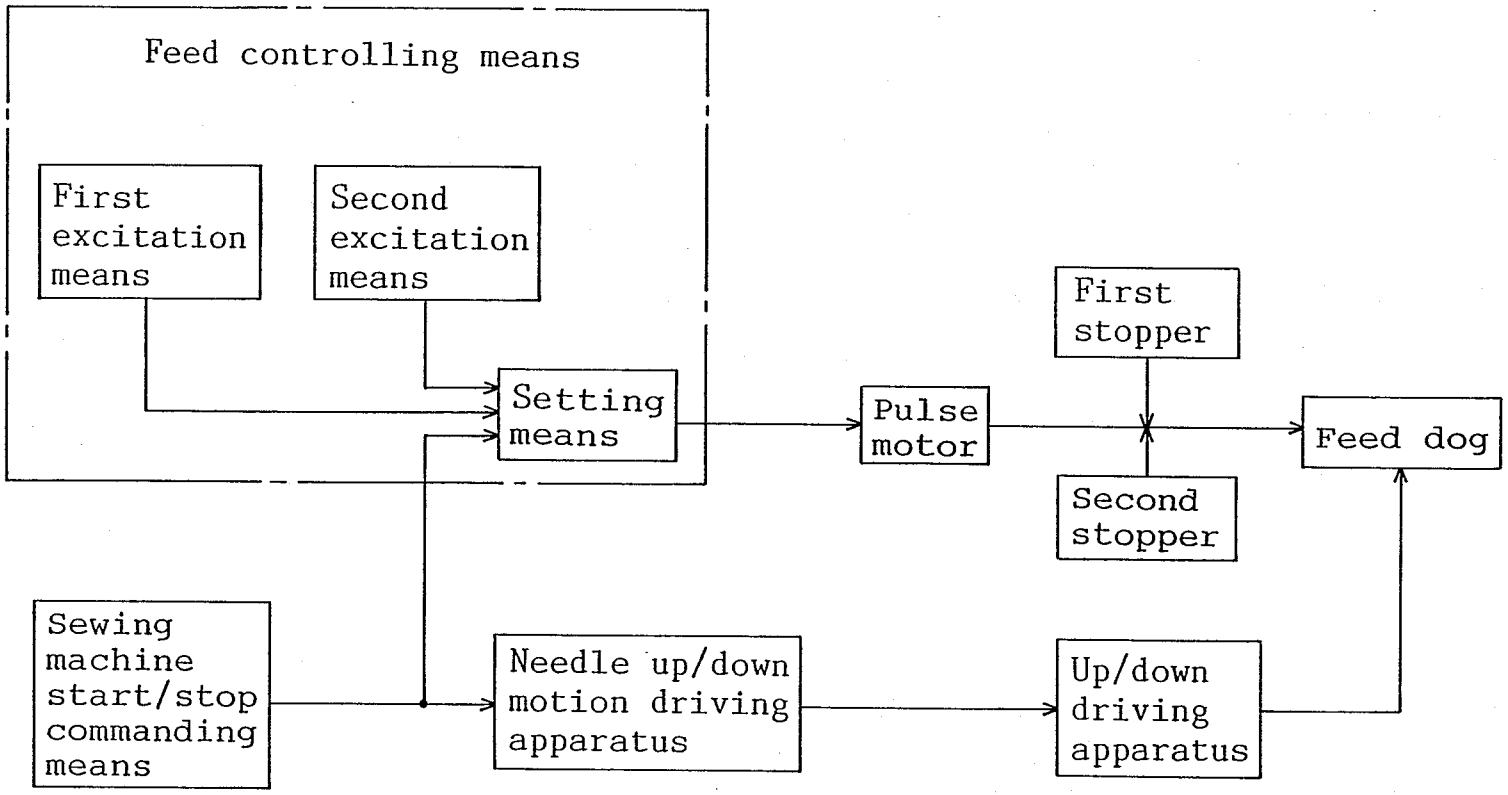
FIG. 1 is a functional block diagram showing a configuration in accordance with the present invention, FIG. 2(*a*) and (*b*) are explanatory views for explaining functions of the present invention which show processes of feeding motions at start-up of a sewing machine and in continuous operation of the sewing machine in the state of out-of-step of a feed pulse motor, FIG. 3 through FIG. 9 relate to a sewing machine whereto a feed device of preferred embodiment of the present invention is applied.

First of all, the inventive concept of the present invention will be described according to FIG. 1 and FIGS. 2(*a*) (*b*). The present invention has a basic configuration as shown in FIG. 1.

In synchronism with the motion of a needle driven up and down by a known needle up/down motion driving apparatus or drive means including a main motor, an up/down driving apparatus performs ascending and descending motions of a feed dog relative to the surface of a work supporting bed.

Feed controlling means controls a pulse motor operatively connected to the feed dog by an open loop contorl system for horizontal feeding motion of the feed dog, and repeatedly switches or pulses the pulse motor in sequence with a predetermined number P of pulses, and rotates the pulse motor by a unit angular amount S for each pulse.

The feed controlling apparatus comprises first and second excitation control circuits cooperating with first and second stoppers, respectively, and sequence setting circuits for preventing loss of synchronization of the feed dog with respect to the sewing needle due to an unintentional slippage of the pulse motor with respect to a reference location for positioning the shaft of the pulse motor known hereinafter as "stepping-out". The feed controlling apparatus eliminates stepping-out both at start-up and during continuous operation of the sewing machine. To define the range of horizontal feeding motion of the feed dog, first and second stoppers define a first limit position on an upstream feeding side of the work fabric and a second limit position on a downstream side opposite to the upstream feeding side, respectively, for stopping the feed dog of a member operatively connected thereto. A first excitation control apparatus controls the excited state of the pulse motor so that the excited state of the pulse motor at the start or end of horizontal feeding motion of the feed dog becomes a first predetermined specific excited state among the excited states into which the pulse motor is excited. This causes the pulse motor to rotate by an angular amount of P·S/2 from a specific position where it is positioned when the feed dog is defined at the first limit position by the first stopper. The second excitation control circuit controls the excited state of the pulse motor so that the excited state of the pulse motor at the end of horizontal feeding motion of the feed dog becomes a second predetermined specific excited state among the excited states into which the pulse motor is excited. This results in the pulse motor rotating by an angular amount of P·S/2 from a specific position where it is positioned when the feed dog is defined at the second limit position by the second stopper.

Sequence setting circuit moves the feed dog to the second limit position so that the second excitation control circuit can operate in the horizontal feeding motion when a sewing machine start command is generated from a sewing machine start/stop commanding circuit, and thereafter moves the feed dog to the first limit position so that the first excitation control circuit can operate in the subsequent horizontal feeding motion.

Figure 2:
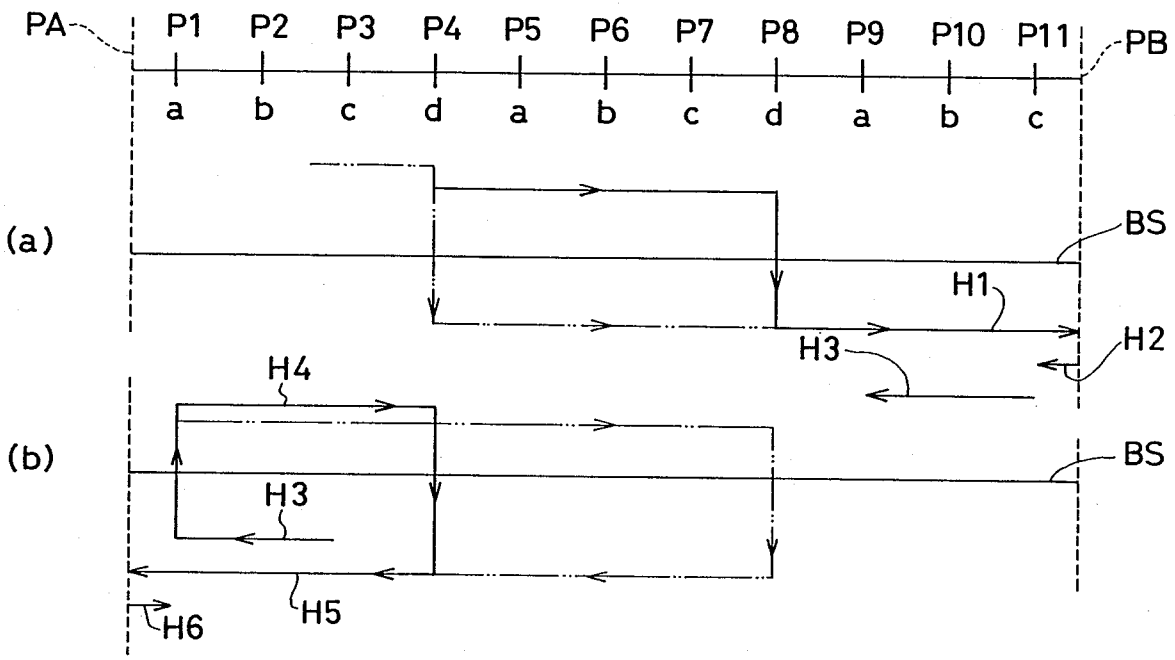

FIGS. 2(*a*) and (*b*) are views conceptually showing apsects of feeding motion of the feed dog of the feed control apparatus in accordance with the present invention. Symbols P1 through P11 show horizontal positions of the feed dog, and the pitch thereof corresponds to a unit amount of rotation S of the pulse motor. Then the excited states of the pulse motor include four states (P=4) as designated by symbols a, b, c and d, and the feed dog moves horizontally between the first limit position PA on the work fabric feeding side and the second limit position PB on the opposite side thereto, performing ascending an descending motions relative to the surface BS of the work supporting bed.

When the sewing machine start command is generated from the sewing machine start/stop commanding circuit to start sewing from the end part of the work fabric in the state that the feed dog protrudes above the bed surface BS and stops at the position P4, the pulse motor continues to be excited in the excited state d to hold the feed dog at the position P4. At this time, the operator moves the work fabric forcedly toward the second limit position PB (in the direction of forward feed) to insert the work fabric between the presser foot and the feed dog, and thereby the pulse motor steps out and the position thereof is changed by an amount of at least four times the unit amount of rotation S. For example, in the normal state, the feed dog is held at the position P4 as shown in a dash-colon line in FIG. 2(*a*), but in the case where the feed dog is displaced to the position P8 in the horizontal direction by step-out of the pulse motor, the sequence setting means command a seven-step movement from the position P4 to the position P11 assumming that the pulse motor is not in step-out state. According to this command, a horizontal feeding motion of a process HI is executed, but a three-step movement is commanded even after the feed dog has reached the position P11, and therefore the feed dog or the member operatively connected thereto contacts the second stopper disposed at the second limit position PB. Thereafter, the second excitation control circuit excites the pulse motor into the state c being the second specific state of excitation, and thereby a horizontal feeding motion of a process H2 is executed, and the feed dog is positioned accurately at the position P11. As a result, the state of a step-out due to feeding of the work fabric at starting of the sewing machine is eliminated.

The pulse motor restored to its normal and synchronized state moves the feed dog, and a horizontal feeding motion in the direction of retreat of a process H3 from the position P11 to the position P1 is executed. After the horizontal feeding motion of the process H3, the feed dog performs an ascending motion, and a forward feeding motion of a process H4 is executed. During the period of this horizontal feeding of the process H4, when an overload in the direction toward the first limit position PA is applied to the pulse motor due to transfer of the thick part of the work fabric or the like, the pulse motor falls into step-out and the position thereof is changed by an amount of at least four times the unit amount of rotation S as described above. For example, in the normal state, as shown by a dash-colon line in FIG. 2(*b*), in the case where a setting is made so that a horizontal feeding motion from the position P1 to the position P8 is performed, and the horizontal feeding motion of the process H4 from the position P1 to the position P4 is executed due to step-out of the pulse motor, the sequence setting circuit commands a seven-step movement from the position P8 to the position P1 assuming that the pulse motor is not in step-out state, According to this command, a horizontal feeding motion of a process H5 is executed, but a four-step movement is commanded even after the feed dog has reached the position P1, and the feed dog or the member operatively connected thereto contacts the first stopper disposed at the first limit position PA. Thereafter, the first excitation control circuit excites the pulse motor into the first specific excited state a, and thereby a horizontal feeding motion of a process H6 is executed, and the feed dog is positioned accurately at the position P1. Resultingly, the state of step-out generated due to transfer of the thick part of the work fabric in the continuous operation after the start of the sewing machine is removed.

As described above, the state of step-out of the pulse motor generated at the start and in the subsequent continuous operation of the sewing machine is automatically eliminated and the stitch pattern deterioration is reduced.

It follows from the detailed description above the feed control apparatus in accordance with the present invention has the configuration wherein the first and second stoppers for defining the first and the second limit positions of the feed dog, respectively, and the first and second excitation control circuits for exciting the feed pulse motor into predetermined phases to position the feed dog at predetermined positions in cooperation with those stoppers are installed, and the sequence setting circuit makes either of the first and second the second excitation control circuits operate in response to the case immediately after starting the sewing machine or the case where the sewing machine is in continuous operation, and therefore even in the case where either of the overload in the direction of forward feed at the start of the sewing machine and the overload in the direction of retreat feed in continuous operation of the sewing machine is applied to the feed dog, stepping-out of the feed pulse motor can be eliminated automatically, and the stitch pattern deterioration due to disorder of the feeding motion can be reduced. Also, the present invention enables a small-sized pulse motor with a small torque to be open-loop-controlled by a relatively simple and economical circuit configuration, and thereby enables the feed device for the sewing machine to be made smaller in size and lower in price.

Hereinafter, description is made on one embodiment in accordance with the present invention in reference to drawings.

Figure 3:
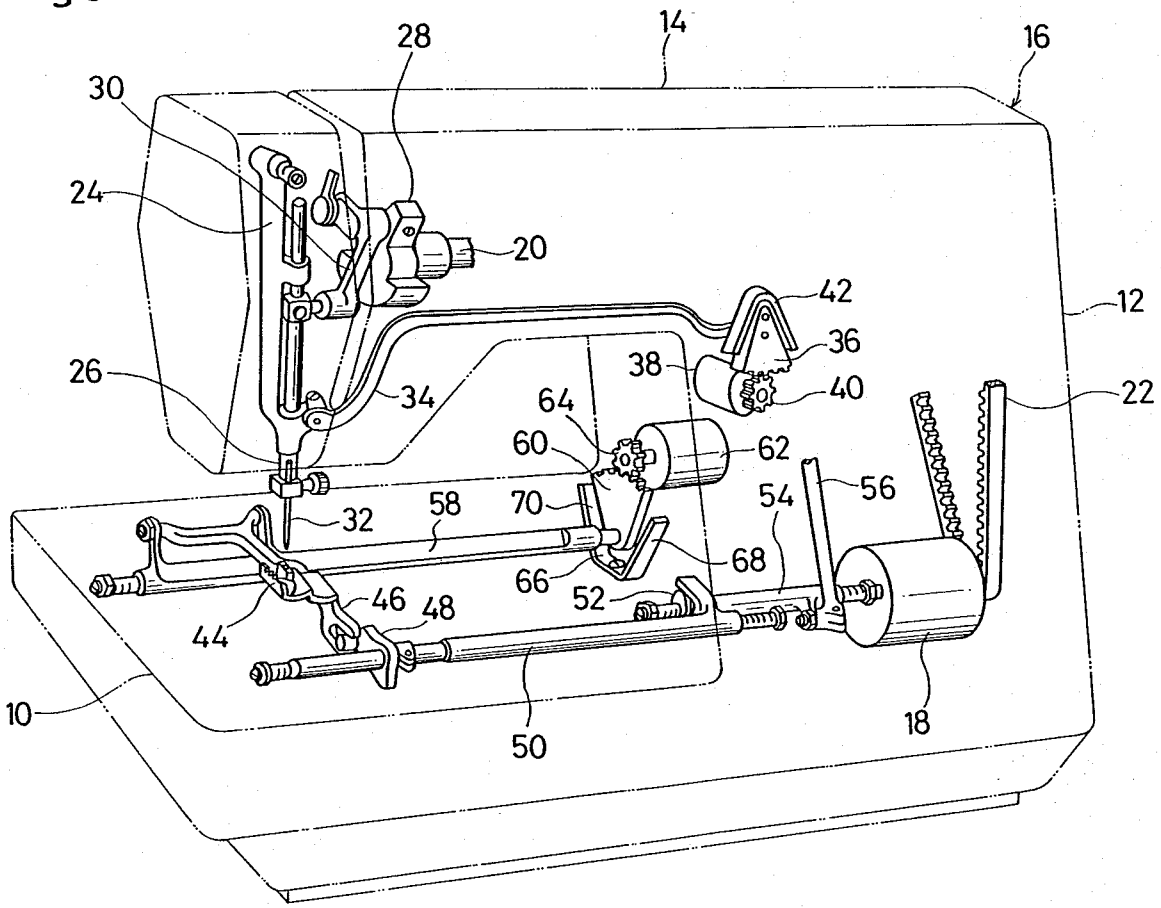
FIG. 3 is a perspective view showing an internal mechanism of the sewing machine.

FIG. 3 shows an internal mechanism of a sewing machine wherein a fabric feed device being one embodiment of the present invention is adopted, and the sewing machine is provided with a sewing machine frame 16 composed of a work supporting bed 10, a standard 12 erected on the work supporting bed 10 and an upper arm 14 extending horizontally from the standard 12. A main motor 18 disposed in the frame 16 is constituted so as to give a rotating force through a pulley driving belt 22 and a pulley (not illustrated) installed on an main shaft 20, and a pulley is connected to the main shaft 20 through a known clutch mechanism.

A needle bar stand 24 is journaled at the top end thereof, supporting a needle bar 26 so as to be movable up and down. The needle bar 26 is connected to the main shaft 20 through a take-up lever crank 28, a needle bar crank rod 30 and the like and performs reciprocating up-and-down motion according to rotation of the main shaft 20. A needle 32 is attached to the bottom end of the needle bar 26. One end of a swing connecting rod 34 is connected to the bottom end of the needle bar stand 24 to swing the needle bar stand 24 in the lateral direction, and the other end thereof is connected to the intermediate part of a sector gear 36, and the sector gear 36 is journaled at the top end thereof being constituted so that the toothed part thereof engages with a gear 40 attached to an output shaft of a needle swinging pulse motor 38. The swing range of the sector gear 36, that is, the swing range of the needle 32 is set by a V-shaped stopper assembly 42. A feed stand 46 carrying and supporting a feed dog 44 is installed, and the front forked ends of the feed stand 46 engage with a pin on an up/-down feed arm 48, and the up/down feed arm 48 is fixed to an up/down feed shaft 50. A swing member 54 whereto a cam 52 engaging with the forked parts of the up/down feed shaft 50 is fixed is constituted so that rotation of the main shaft 20 is transmitted as a swinging motion through a crank rod 56. In this embodiment, the up/down feed arm 48, the up/down feed shaft 50, the swing member 54, the crank rod 56 and the like constitute a feed dog up/down motion driving apparatus.

The rear end of the feed stand 46 is supported rotatably by a pair of arms protruding on a horizontal feed shaft 58, and the horizontal feed shaft 58 is supported by the machine frame 16 so as to be able to swing around the shaft axis of its own. A sector gear 60 is fixed to the right end of the horizontal feed shaft 58, and the toothed part thereof is constituted so as to engage with a gear 64 fixed to an output shaft of a feed pulse motor 62. To define the range of horizontal feeding motion of the feed dog 44, a V-shaped stopper assembly 66 is installed in a fixed fashion, and the stopper assembly 66 has a first stopper 68 disposed at the position corresponding to a first feed limit position PA on the work fabric feeding side (front side) and a second stopper 70 disposed at the position corresponding to a second feed limit position PB on the rear side the first stopper 68 being located upstream from the second stopper 70.

In addition, the first stopper 68 may be installed in the vicinity of the first feed limit position PA, or may directly catch the feed dog 44 to define the first feed limit position PA.

Likewise, the second stopper 70 may be installed in the vicinity of the second feed limit position PB, or may directly catch the feed dog 44 to define at the second feed limit position PB.

Figure 4:
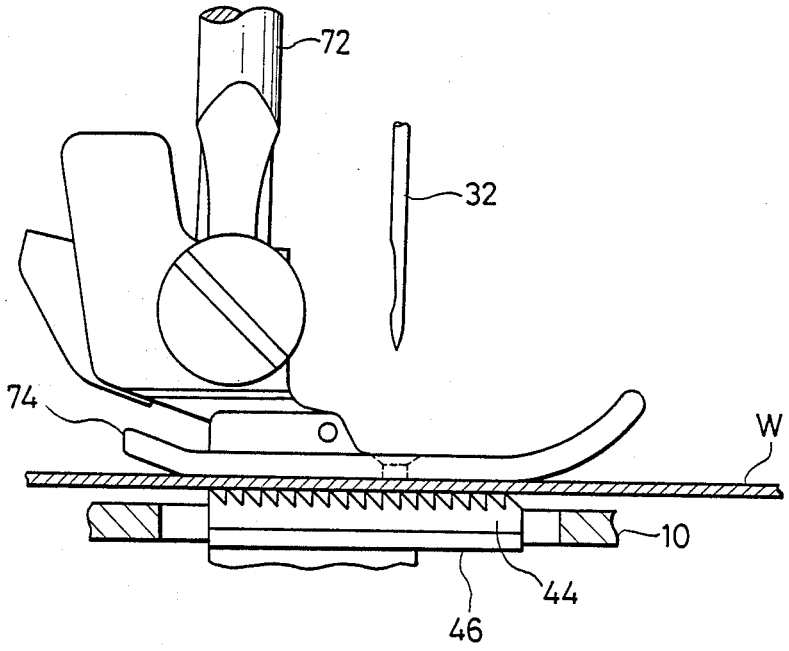
FIG. 4 is an enlarged side view showing the state of feeding fabric by means of a presser foot and a feed dog.
Figure 9:
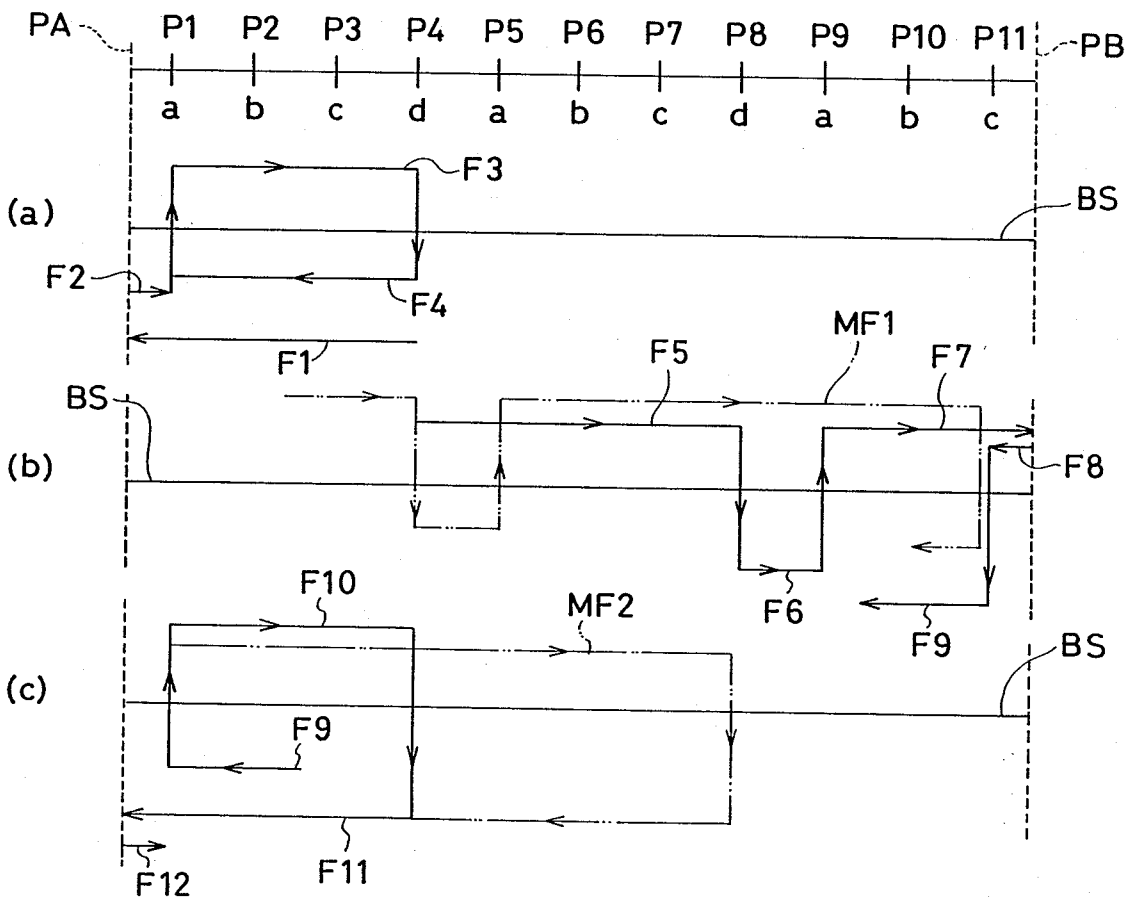

Although omitted in FIG. 3 for convenience sake, as shown in FIG. 4, a presser foot 74 is attached to the bottom end of a presser bar 72 which can ascend or descend behind the needle 32, and the feed dog 44 can give horizontal feeding motion to a work fabric W in cooperation with the presser foot 74. Also, in the sewing machine of this embodiment, the needle swinging pulse motor 38 and the feed pulse motor 62 are constituted so as to be changed in sequence to the four states of excitation a, b, c and d to step, and particularly the feed pulse motor 62 can position the feed dog 44 at each of the positions P1 through P11 as shown in FIG. 9.

Figure 5:
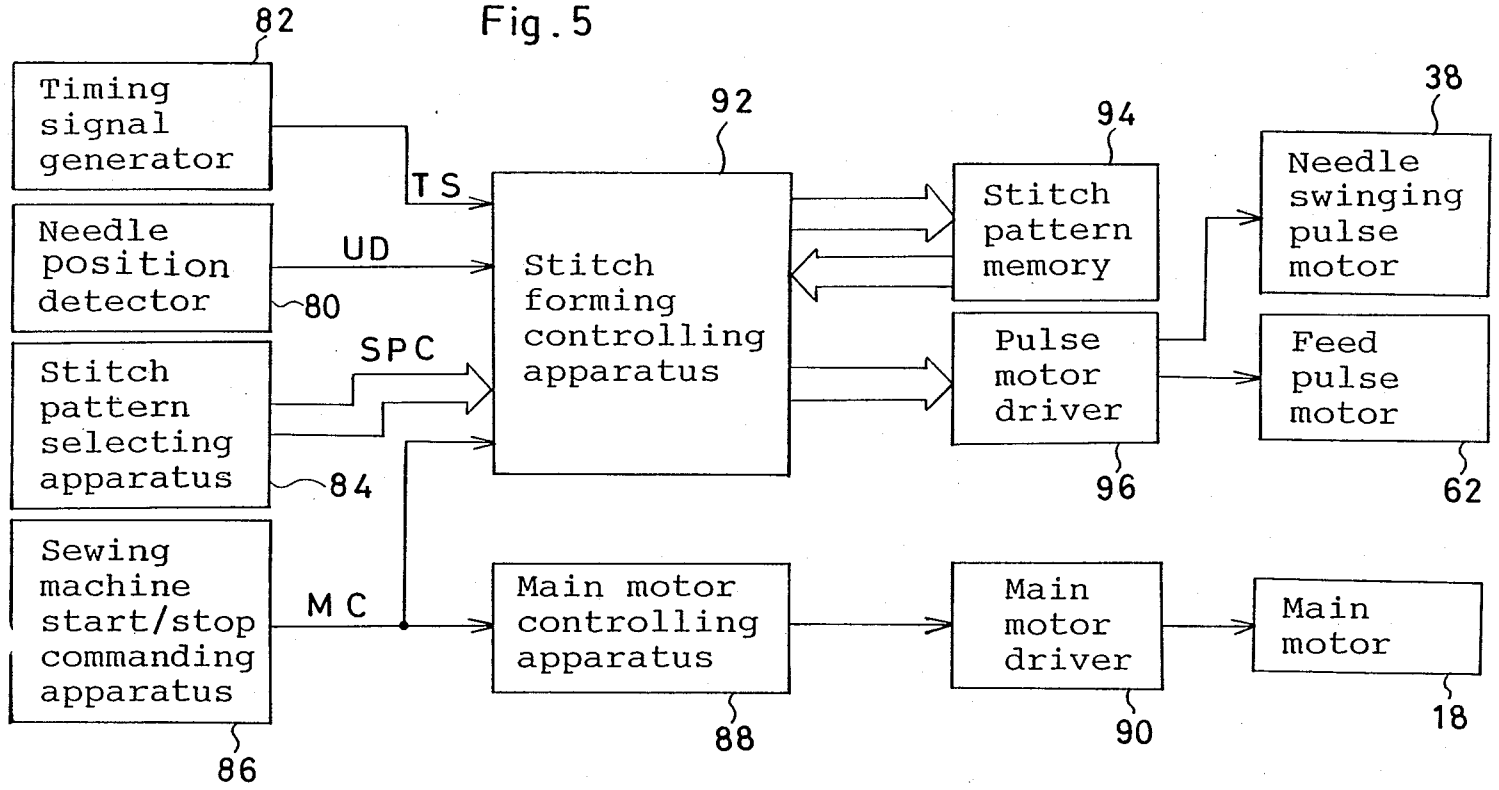
FIG. 5 is a block diagram showing an electric configuration of the sewing machine, FIGS. 6(*a*) through (*c*) are timing charts showing needle position signals and timing signals with respect to up-and-down motion of a needle, FIGS. 7(*a*) through (*c*) are flow charts showing operation of the sewing machine, FIGS. 8(*a*) and (*b*) are flow charts showing details of a feed control routine, and FIGS. 9(*a*) through (*c*) are explanatory views showing processes of normal feeding motion and processes at start-up of the sewing machine and in continuous operation of the sewing machine in the state of out-of-step of the feed pulse motor.

Next, description is made on an electric configuration of the sewing machine in reference to FIG. 5.

Figure 6:
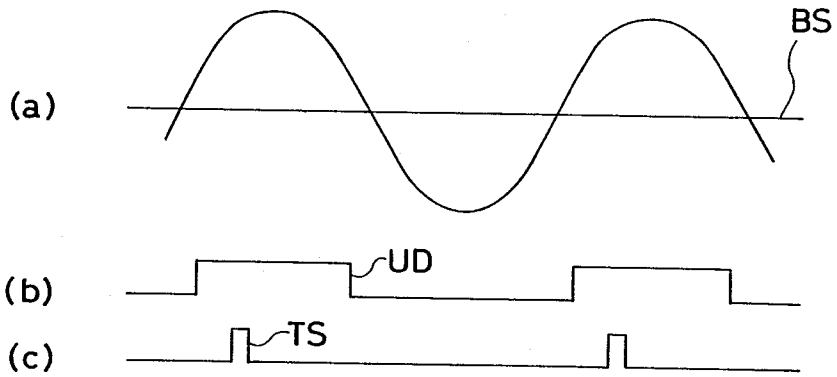

A needle position detector 80 detects the position of the tip of the needle 32 making up-and-down motion as shown in FIG. 6(*a*), and is constituted so as to generate a needle position signal UD which, as shown in FIG. 6 (*b*), has high level while the tip of the needle 32 is positioned above a predetermined position above the surface BS of the machine bed, and has low level while the tip is positioned below the predetermined position. A timing signal generator 82 is installed to determine the timing of reading out data from a stitch pattern data memory 94 as described later, and is constituted so as to generate a timing signal TS which has a high level temporarily when the tip of the needle 32 reaches a predetermined position above the machine bed surface BS as shown in FIG. 6(*c*).

A stitch pattern selecting apparatus 84 comprises a manual operating unit operative for selecting a desired stitch pattern from among a large number of stitch patterns and is constituted so as to generate a stitch pattern code signal SPC corresponding to the stitch pattern selected by operating the unit. A sewing machine start/-stop commanding apparatus 86 comprises an operative unit operable for commanding operation and stop of the main motor 18 and is constituted so as to generate a command signal MC according to the operation of the unit. A main motor controlling apparatus 88 operates a main motor driver 90 according to a signal commanding the speed of the main motor 18 and the command signal MC, and controls the amount of electric power supplied to the main motor 18.

Figure 7A:
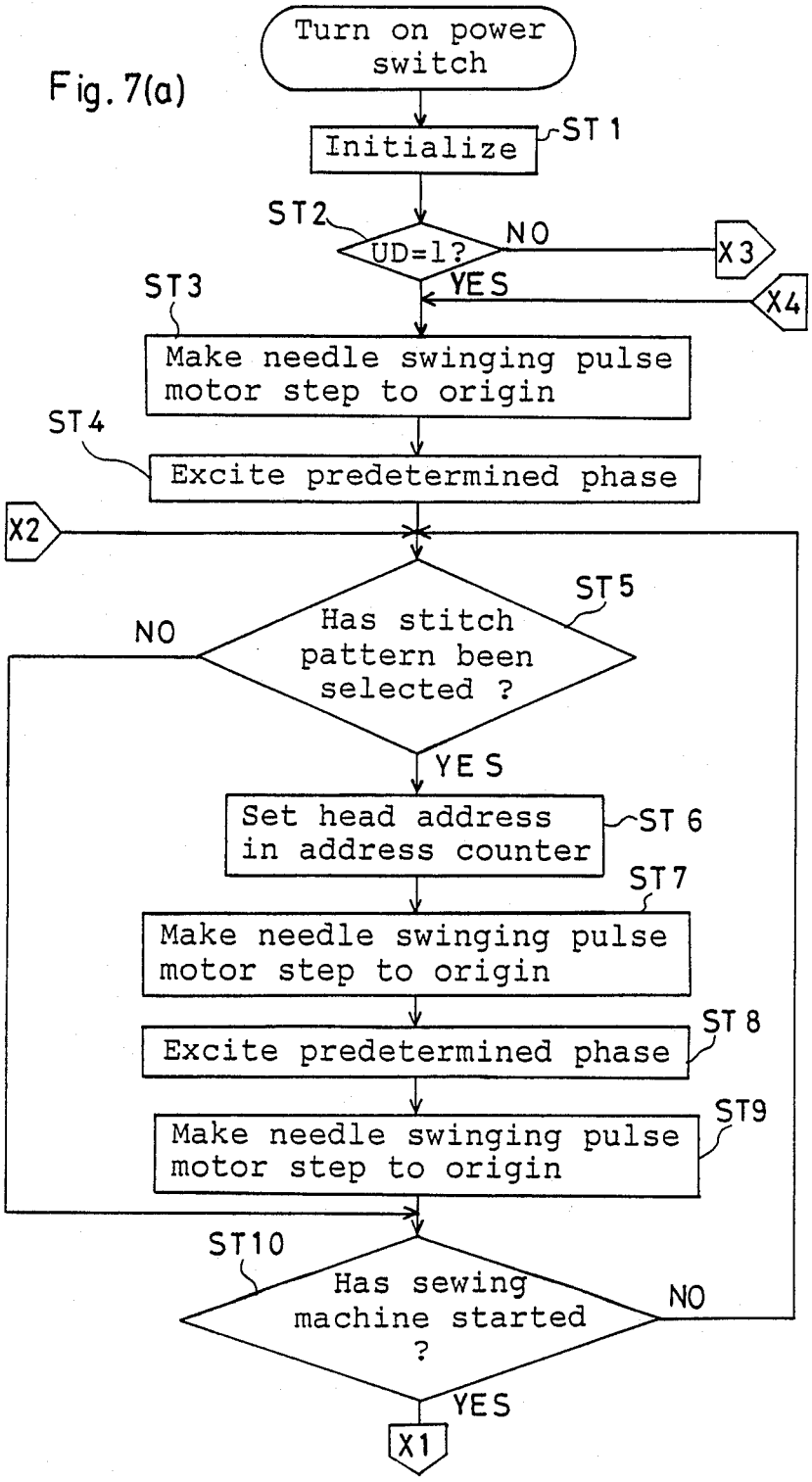
Figure 7B:
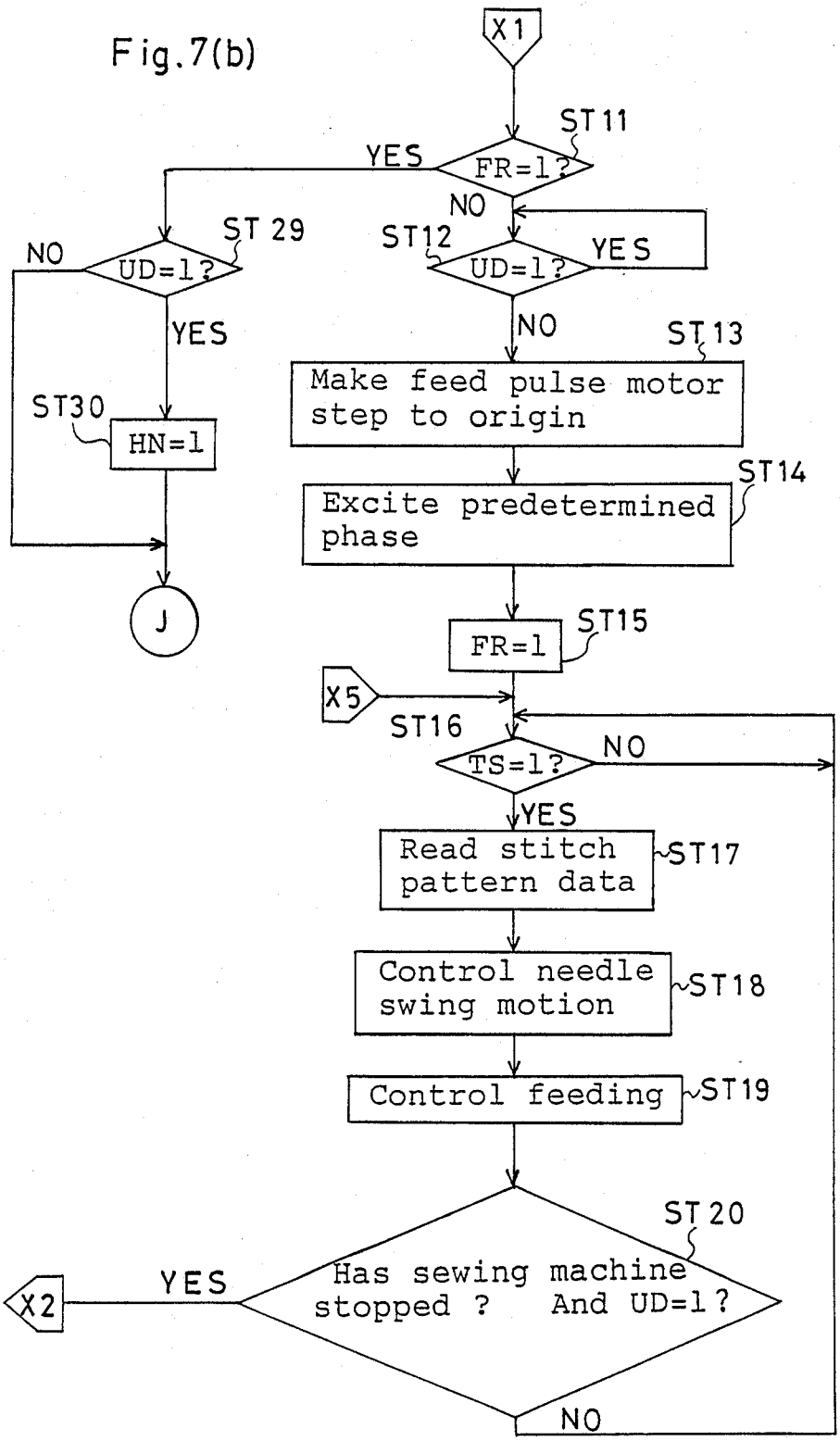
Figure 7C:
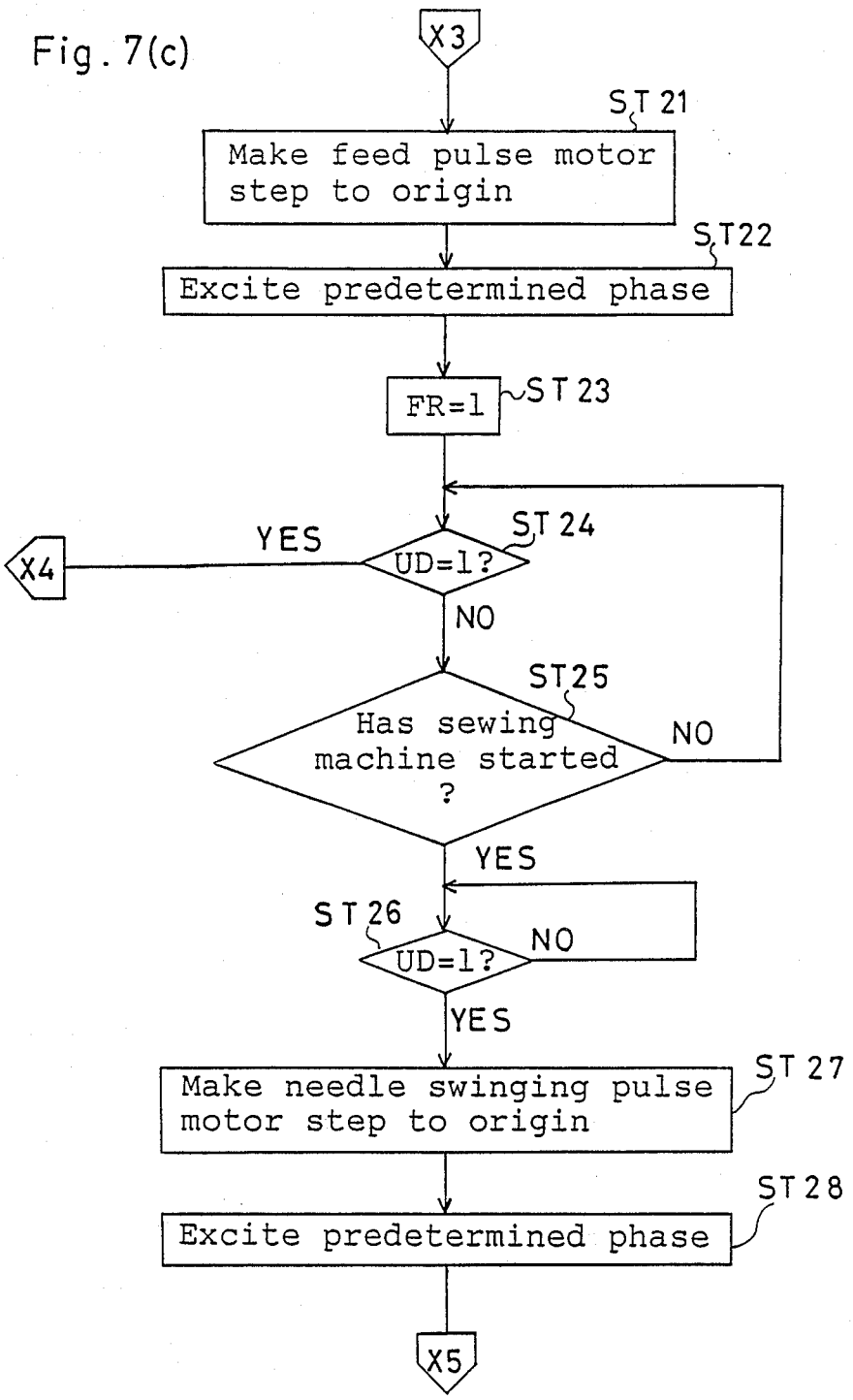
Figure 8A:
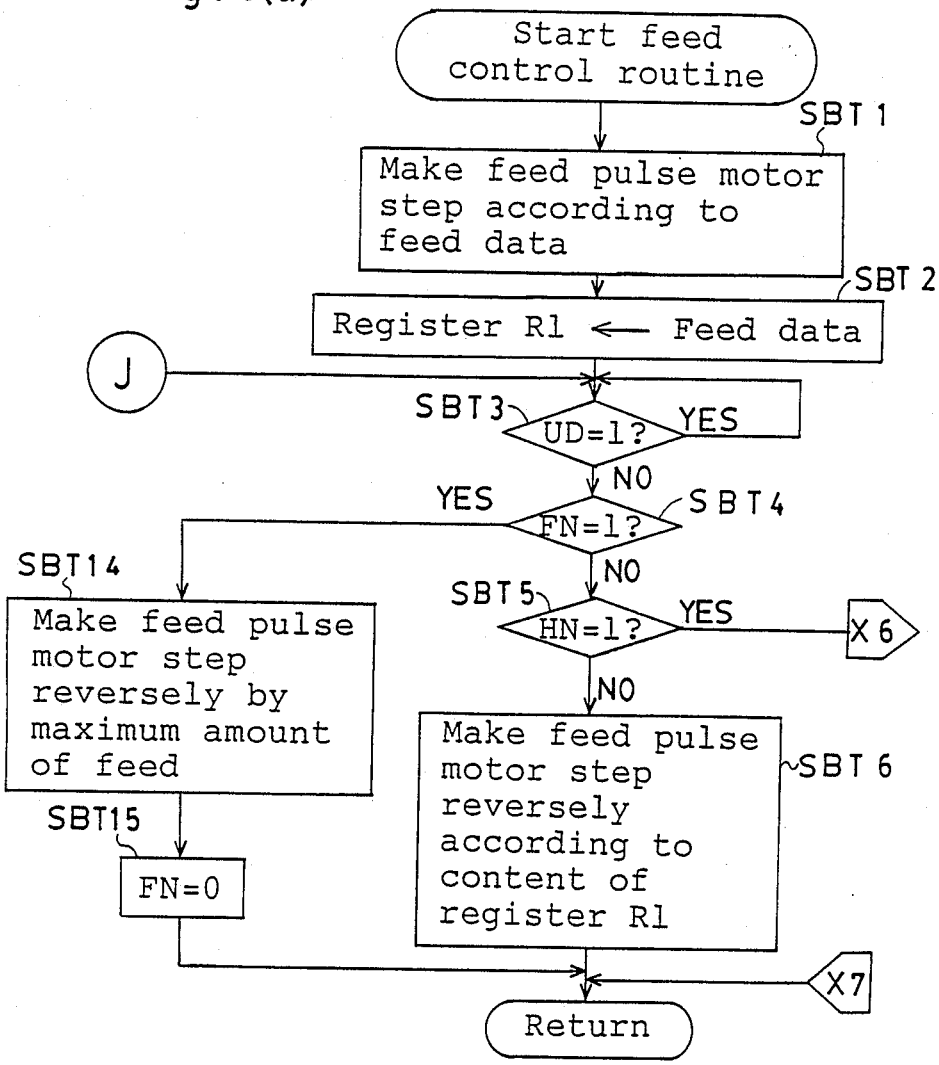
Figure 8B:
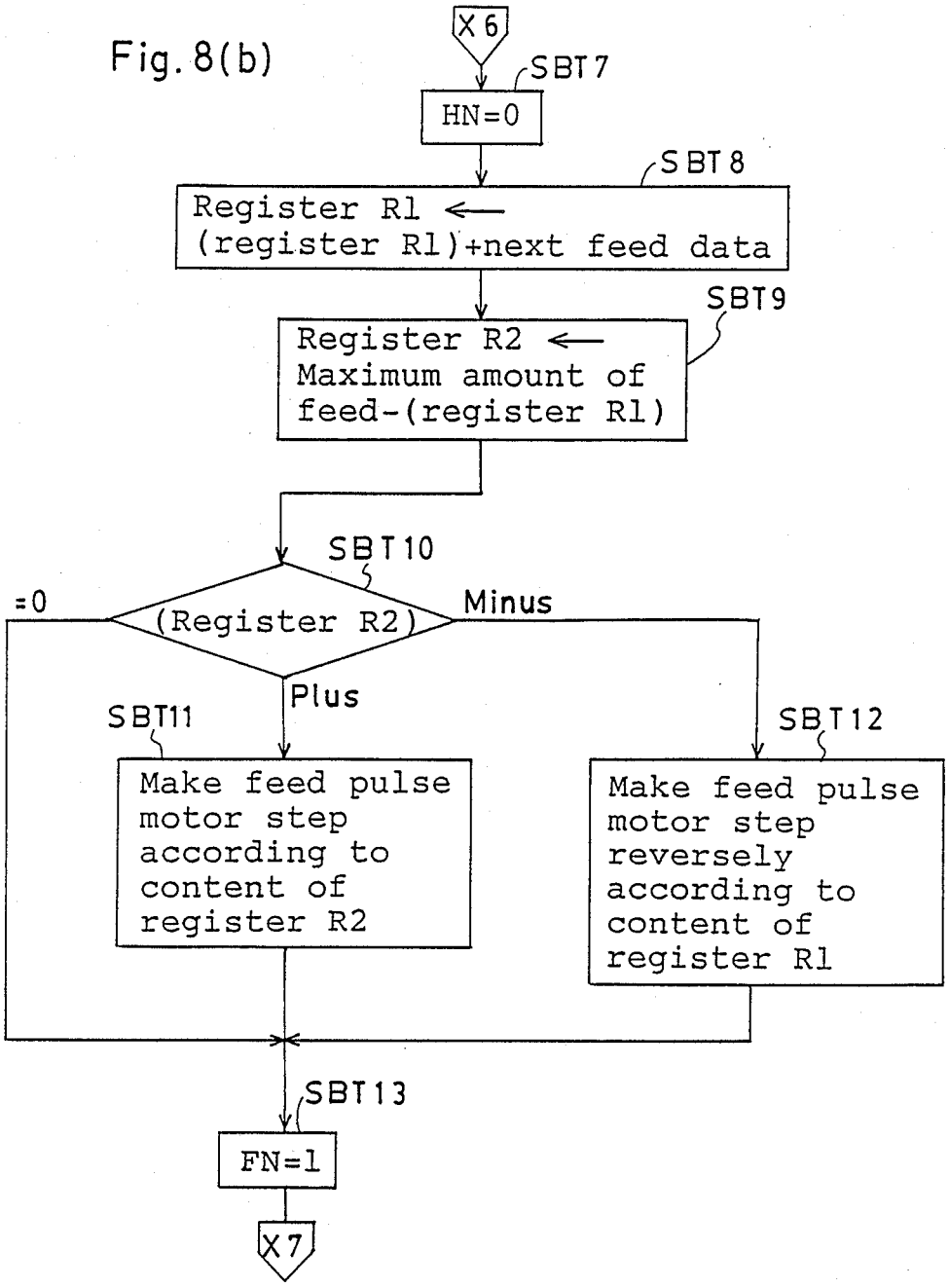

A stitch forming controlling apparatus 92 is installed to control stitch forming operation in the sewing machine, and is constituted so as to receive the above-described timing signal TS, needle position signal UD, stitch pattern code signal SPC and command signal MC as input signals, to read out data from a stitch pattern data memory 94 and to control a pulse motor driver 96, also being constituted so as to execute processing operations according to flow charts as shown in FIGS. 7 and 8. The stitch forming controlling apparatus 92 comprises an address counter performing addressing of the stitch pattern data memory 94, internal registers R1 and R2, and registers for storing various flags.

Also, the stitch pattern data memory 94 stores stitch pattern data consisting of needle swing data on the swing position of the needle 32 and feed data, on the amount of horizontal feed of the feed dog 44 and the direction of feed thereof to determine the position of stitch forming for each of a large number of stitch patterns, and is constituted so as to output the stitch pattern data in the address specified by an address counter in the stitch forming controlling apparatus 92 to that controlling apparatus 92. In addition, for stitch patterns formed by the sewing machine of this embodiment, practical stitch patterns for which only the forward feeding motion from the first feed limit position PA (front side) to the second feed limit position PB (rear side) is used are selected for convenience sake.

Description is made on operations of the sewing machine constituted as described above in reference to FIG. 7 through FIG. 9.

First, when power to the sewing machine is turned on, step ST1 as shown in FIG. 7(*a*) is executed to initialize the stitch forming controlling apparatus 92. For example, for initialization thereof, an operation setting the address counter to the head address for straight line stitches, an operation clearing the internal registers R1 and R2, and an operation clearing registers for flags FR, HN and FN and the like are executed. Thereafter, the level of a needle position signal UD is checked in step ST2. Normally, the needle 32 is positioned above the bed surface BS when the sewing machine is stopped, and therefore steps ST3 and ST4 are executed in sequence. By executing these steps ST3 and ST4, the needle swinging pulse motor 38 is driven until the sector gear 36 contacts the end determined as an original position stopper out of both ends of the stopper assembly 42, and a predetermined phase out of two excitation phases to be excited during a two-step movement from the original position stopper is excited, and origin setting of the pulse motor 38 is performed.

The stitch forming controlling apparatus 92 detects a change in the stitch pattern code signal SPC from the stitch pattern selecting apparatus 84, and thereby discriminates the selected stitch pattern in step ST5. In discriminating the selected stitch pattern, the head address corresponding to the selected stitch pattern is set in the address counter, and origin setting of the needle swinging pulse motor 38 is executed in steps ST7 and ST8 likewise the above-described steps ST3 and ST4. Then, in step ST9, the address counter address-specifies the stitch pattern data memory 94 and reads out a first stitch pattern data on the selected stitch pattern, the needle swinging pulse motor 38 is driven according to the needle swing data in that stitch pattern data, and thereby the swing position of the needle 32 at the first stitch is determined. Thereafter, in step ST10, the stitch forming controlling apparatus 92 detects whether or not the command signal MC from the sewing machine start/stop commanding apparatus 86 has changed to the high level showing start-up of the sewing machine, and when it detects a change to the high level, processing proceeds to step ST11 shown in FIG. 7(*b*), and the content of the flag FR is discriminated.

As shown in FIG. 7(*b*), immediately after power to the sewing machine has been turned on, since the flag FR has been reset in step ST1, reset of the flag FR is discriminated in step ST11, and step ST12 is executed. In step ST12, the level of the needle position signal UD is discriminated, and processing proceeds to step ST13 when the needle 32 is positioned below the bed surface BS to form the first stitch, and when the needle 32 is positioned above the bed surface BS, processing proceeds to step ST13 after the needle 32 has moved below the bed surface BS. In the sewing machine of this embodiment, the first stopper 68 of the stopper assembly 66 is used as a stopper for origin setting, and therefore, in step ST13, the feed pulse motor 62 is driven by steps of a number enough for the sector gear 60 to contact the first stopper 68, and thereby the feed dog 44 makes a retreat feeding motion of a process F1 to the first feed limit position PA as shown in FIG. 9(*a*). Then, in step ST14, the feed pulse motor 62 is excited into the predetermined phase a, and the feed dog 44 makes a forward feeding motion of a process F2, being positioned at the position P1 being the original position. In addition, the above-mentioned predetermined phase a is predetermined out of the phases a and b excited while the feed pulse motor 62 is moved by two steps from a specific position where the sector gear 60 contacts the first stopper 68.

After origin setting of the feed pulse motor 62 has been made, step ST15 is executed, and the flag FR is set, and thereafter the needle 32 ascends and the feed dog 44 protrudes above the bed surface BS. Then, in step ST16, the generation of timing signal TS is discriminated, and when generation of the timing signal TS is discriminated, step ST17 is executed and readout of data from the stitch pattern data memory 94 is performed. This data readout operation is performed by a system well known generally, and a second stitch pattern data on the selected stitch pattern is read by the address counter whose count accumulates in response to the timing signal TS. Also, a program is set in a manner that when the read data is a datum showing the end of the stitch pattern data of the selected stitch pattern, the head address of that stitch pattern is set again in the address counter. In step ST18, the needle swinging pulse motor 38 is driven according to the needle swing data in the read stitch pattern data, and the swing position of the needle 32 at the second stitch is determined. Subsequently, step ST19 is executed, and the feed pulse motor 62 is driven according to the feed data in the above-mentioned read stitch pattern data.

A feed control routine in step ST19 is programmed as shown in detail in FIGS. 8(*a*) and (*b*). This means that in step SBT1 as shown in FIG. 8(*a*), the feed pulse motor 62 is driven by steps of a number and direction (forward direction) in accordance with the feed data, and the feed dog 44 performs a forward feeding motion of a process F3. In step SBT2, the feed data is stored temporarily in the internal register R1, and in step SBT3, the level of the needle position signal UD is discriminated. When the needle 32 descends below the bed surface BS to form the second stitch and the feed dog 44 descends, in steps SBT4 and SBT5, the contents of the flags FN and HN are discriminated in sequence. At the present point, the flags FN and HN are reset, and accordingly step SBT6 is executed, and the feed pulse motor 62 is driven in the direction of retreat by steps of a number according to the feed data in the internal register R1, and the feed dog 44 performs a retreat feeding operation of a process F4, returning to the position P1. Then, as shown in FIG. 9(*a*), the four conventional feeding motions well known are performed, and in step ST20 as shown in FIG. 7(*b*), continuous operation of the sewing machine is performed until generation of the command signal MC commanding stop of the sewing machine and generation of the high-level needle position signal UD are discriminated simultaneously, and thereby a desired stitch pattern is formed.

Then, in step ST2, when the low level of the needle position signal UD is discriminated immediately after power to the sewing machine has been turned on, steps ST21, ST22 and ST23 shown in FIG. 7(*c*) are executed likewise the above-described steps ST13 through ST15 to perform origin setting of the feed pulse motor 62. Thereafter, the high level of the needle position signal UD is discriminated in step ST24, and when the needle 32 is positioned above the bed surface BS, processing proceeds to step ST3, and when positioned below the bed surface BS, the level of the command signal MC is discriminated in step ST25. In step ST25, when stop of the sewing machine is discriminated, processing returns to step ST24, and step ST24 is executed, and when start of the sewing machine is discriminated, the level of the needle position signal UD is discriminated in step ST26, and when the needle position signal UD changes to the high level, steps ST27 and ST28 for origin setting of the needle swinging pulse motor 38 are executed likewise the above-described steps ST3 and ST4. Thereafter, execution of steps ST16 through ST20 is repeated during the operation of the sewing machine, and stitch pattern forming is executed.

Subsequently, description is made hereinafter on the operation of the fabric feed device of this embodiment for eliminating step-out of the feed pulse motor 62 at start-up of the sewing machine and in continuous operation of the sewing machine.

Now, in the case as shown by a dash-colon line in FIG. 9(*b*), where the feed dog 44 is positioned at the position P4, protrudes from the bed surface BS and is stopped, and the feed pulse motor 62 is excited into and held at the phase d, if the sewing machine is started in this state, at the beginning the operator sometimes transfers forcedly the work fabric W in the forward direction to feed the work fabric W between the feed dog 44 and the presser foot 74, and the feed pulse motor 62 sometimes steps out into the next phase d in the forward direction due to this forced transfer. A forward feeding operation of a process F5 as shown in FIG. 9(*b*) is generated by the above-described out-of-step.

Description is made on operation of the stitch forming controlling apparatus 92 in the case where step-out is generated at start-up of the sewing machine. Start of the sewing machine is discriminated in step ST10, and subsequently the content of the flag FR is discriminated in step ST11, but when origin setting operation of the feed pulse motor 62 is executed once, the flag FR is set, and accordingly step ST29 is executed. When the needle position signal UD is high, the flag HN is set in step ST30, and when it is low, step ST30 is not executed, and processing moves to step SBT3 as shown in FIG. 8(*a*). When the low level of the needle position signal UD is discriminated in that step SBT3, the contents of the flags FN and HN are discriminated in steps SBT4 and STB5, but as described above, when the needle position signal UD is high immediately after the start of the sewing machine, the flag HN is set, and accordingly the flag HN is reset in step SBT7 shown in FIG. 8(*b*), step SBT8 is executed, the content of the internal register R1 and the next feed data are added, and the result thereof is stored temporarily in the internal register R1. Thereafter, step SBT9 is executed, and the content of the internal register R1 is subtracted from the maximum amount of feed of the feed dog 44, and the results thereof is stored temporarily in the internal register R2. In addition, in this embodiment, the maximum amount of feed of the feed dog 44 is equivalent to the amount of feed from the position P1 to the position P11.

The content of the internal register R2 is discriminated in step SBT10, and when the content is plus, step SBT11 is executed, and when it is minus, step SBT12 is executed, and thereafter processing proceeds to step SBT13, but when it is zero, processing proceeds directly to step SBT13. For example, when the content of the internal register R2 is "1", step SBT11 is executed and the feed pulse motor 62 is driven in the direction of forward feed by one step, and the feed dog 44 performs a forward feeding motion of a process F6. After the flag FN has been set in step SBT13, processing proceeds to step ST20 to perform discriminating operation, and when generation of the timing signal TS is discriminated in step ST16, the next stitch pattern data is read out in step ST17, positioning of the needle 32 is performed according to the needle swing data in that stitch pattern data in step ST18, and subsequently in step SBT1, the feed pulse motor 62 is driven according to the feed data in the stitch pattern data. This feed data is for executing a process MF1 of six-step forward feeding motion as shown by a dash-colon line in FIG. 9(*b*), and therefore the feed dog 44 performs a forward feeding motion of a process F7 from the position P9, and the sector gear 60 contacts the second stopper 70 whose position corresponds to the second feed limit position PB. In this embodiment, in the feed pulse motor 62, excitation change equivalent to six steps is performed and the final excitation phase is determined to be the phase c. This predetermined phase c is one phase out of the phases b and c into which the feed pulse motor 62 is excited while the sector gear 60 moves by two steps from the defining position where it contacts the second stopper 70. Accordingly, when the feed pulse motor 62 is excited into the predetermined phase c, the feed dog 44 performs a retreating horizontal feeding motion of a process F8, and thereby step-out of the feed pulse, motor 62 is eliminated. Thereafter, when the feed dog 44 descends, the low level of the needle position signal UD is discriminated in step SBT3, and the content of the flag FN is discriminated in step SBT4. When a motion equivalent to the horizontal feeding motion of the process MF1 is executed after start of the sewing machine, the flag FN is set, and accordingly setting of the flag FN is discriminated in step SBT4, and in step SBT14, the fed pulse motor 62 is driven in the direction of retreat by 10 steps equivalent to the maximum amount of feed, and the feed dog 44 performs a retreating horizontal feeding motion of a process F9 to the position P1. Thereafter, the flag FN is reset in step SBT15, and processing proceeds to step ST20.

Description is made on the case where the sewing machine is started and is put in continuous operation as described above, and thereafter an overload in the direction of retreat is applied to the feed dog 44 due to transfer of the thick part of the work fabric W or the like, and thereby the feed pulse motor 62 falls into step-out.

For example, in the case of continuous operation of the sewing machine, an overload is applied when a process MF2 of seven-step forward feeding motion as shown by a dash-colon line in FIG. 9(*c*) is executed, and the actual feeding motion is a motion of a process F10, in step SBT6 as shown in FIG. 8(*a*), the feed pulse motor 62 is driven in the direction of retreat by seven steps of the motion of the process MF2, and accordingly the feed dog 44 is made to retreat until the sector gear 60 contacts the first stopper 68 whose position corresponds to the first feed limit position PA, performing a horizontal feeding motion of a process F11. At the end of this process F11, the feed pulse motor 62 is excited into the predetermined phase a, and therefore the feed dog 44 performs a process F12, being positioned at the position P1. Thus, out-of-step of the pulse motor 62 in continuous operation of the sewing machine is eliminated.

In addition, in this embodiment, the operation according to steps SBT6 and SBT14 is equivalent to the operation of the first excitation controlling means, the operation according to step SBT1 is equivalent to the operation of the second excitation controlling means, and the operation according to steps ST29, ST30, SBT1, SBT3 through SBT6 and SBT14 and the like is equivalent to the operation of the movement sequence setting means.

The present invention is not to be limited to the embodiment as detailed above, and various changes and modifications may be made therein without departing from the spirit and scope of the present invention as claimed.

For example, in this embodiment, the stitch forming controlling apparatus 92 and the main motor controlling apparatus 88 are constituted separately, but these apparatuses may be constituted with a microcomputer.

Also, in this embodiment, the motion of the process F7 toward the second feed limit position PB is executed as a motion of forward feed of the work fabric W by the feed dog 44 after start of the sewing machine, but it is needless to say that the motion of the process F7 may be changed to the motion of the process H1 in the state that the feed dog descends as shown in FIG. 2.

Furthermore, in this embodiment, the start position of the horizontal feeding motion in continuous operation of the sewing machine is determined to be position P1, but the start position can be determined to be an arbitrary position, or the start position may differ in every horizontal feeding motion. Thus, in the case where the start position differs from the position P1, a change may be made in a manner that the operation of exciting the predetermined phase at start or end of the horizontal feeding motion is performed every several times of the horizontal feeding motions.

Further, as feeding means driven directly by the feed pulse motor, it is possible to arrange plural roller means driven directly by the feed pulse motor, instead of the feed dog.

What is claimed is:

1. A feed control apparatus for a sewing machine adapted to feed a work fabric to a sewing needle from and upstream location to a downstream location and having an endwise reciprocating needle, a stitch forming controlling means and a presser foot for pressing a work fabric on a work supporting bed; a feed device having a feed dog for horizontally feeding the work fabric from the upstream location to the downstream location in cooperation with said presser foot while the work fabric is positioned above the surface of said work supporting bed; driving means for driving said feed dog and down relative to said bed surface in synchronization with up-and-down motion of said needle; a pulse motor having a predetermined number P of excited states and adapted to rotate by a predetermined angular amount S by switching the pulse motor between each excited state, said pulse motor being operatively connected with said feed dog; and feed controlling means performing feed control of the work fabric by sequentially switching the excited state of said pulse motor using an open loop control system according to a feed signal from the stitch forming controlling means relating to the amount of horizontal feed of said feed dog; said feed controlling means comprising:

a first stopper and a second stopper defining a first limit position and a second limit position downstream from said first limit position, respectively, for stopping said feed dog or a member operatively connected thereto, in order to define the range of horizontal feeding motion of said feed dog;

first excitation control means for controlling the excited states of said pulse motor so that the excited state of said pulse motor at the start or end of horizontal feeding motion of said feed dog becomes a first predetermined specific excited state into which said pulse motor is excited while said pulse motor rotates by a angular amount of P·S/2 away from a specific position where said pulse motor is positioned, when said feed dog is defined at the first limit position by said first stopper;

second excitation control means for controlling the excited states of said pulse motor so that the excited state of pulse motor at the end of horizontal feeding motion of said feed dog becomes a second predetermined specific excited state into which said pulse motor is excited while said pulse motor rotates by an amount of P·S/2 away from a specific position where said pulse motor is positioned, when said feed dog is defined at the second limit position by said second stopper; and sequence setting means for moving said feed dog to said second limit position so that said second excitation control means becomes operative in horizontal feeding motion at the start-up of the first sewing operation and for moving said feed dog to said first limit position so that said first excitation control means becomes operative during subsequent horizontal feeding motion.

2. A feed control apparatus for a sewing machine in accordance with claim 1, wherein said driving means comprises a crank rod connected to a main shaft of said sewing machine, a swing member driven to swing up and down by said crank rod, an up/down feed shaft rotated by said swing member through a cam, an up/down feed arm driven to swing up and down by said up/down feed shaft and a feed stand which is driven up and down by said up/down feed arm and drives said feed dog up and down.

3. A feed control apparatus for a sewing machine in accordance with claim 1, wherein said feed dog is operatively connected to said pulse motor through a sector gear driven by said pulse motor and a horizontal feed shaft rotated by said sector gear.

4. A feed control apparatus for a sewing machine in accordance with claim 3, wherein said first stopper and second stopper are constituted as a one-piece member with a V-shaped stopper assembly disposed outside said sector gear.

5. A feed control apparatus for a sewing machine in accordance with claim 1, wherein said feed controlling means is adapted to read said feed signal relating to the amount of horizontal feed of said feed dog from memory means which stores stitch pattern data for each of a large number of stitch patterns.

6. A feed control apparatus for a sewing machine in accordance with claim 5, wherein said feed controlling means is further adapted to receive a command signal from sewing machine start/stop commanding means, a stitch pattern code signal from stitch pattern selecting means, a needle position signal from a needle position detector for detecting the position of said needle with respect to said bed surface and a timing signal from a timing signal generator for detecting a predetermined movement of the needle bar when the tip of said needle reaches a predetermined position above said bed surface, and to read said feed signal relating to the amount of said horizontal feed every time said timing signal is inputted.

7. A feed control apparatus for a sewing machine having a stitch forming controlling means; a presser foot for pressing a work fabric on a work supporting bed a feed member giving a horizontal feeding motion to the work fabric in cooperation with said pressure foot to move the work fabric from an upstream location to a downstream location; a pulse motor having a predetermined number P of excited states and adapted to rotate by a predetermined angular amount S by switching the pulse motor between each excited state, said pulse motor being operatively connected with said feed member; and feed controlling means for performing feed control of the work fabric by sequentially switching the excited state of said pulse motor by an open loop control system according to a feed signal the stitch forming controlling means relating to the amount of horizontal feed of said feed dog; said feed controlling means comprising:

a first stopper and a second stopper for defining a first limit position and a second limit position downstream from said first limit position, respectively, for stopping said feed member or a member operatively connected thereto, in order to define the range of horizontal feeding motion of said feed member;

first excitation control means for controlling the excited states of said pulse motor so that the excited state of said pulse motor at the start or the end of horizontal feeding motion of said feed member becomes a first predetermined specific excited state into which said pulse motor is excited while said pulse motor rotates by an angular amount of P·S/2 from a specific position where said pulse motor is positioned, when said feed member is defined at the first limit position by said first stopper;

second excitation control means for controlling the excited states of said pulse motor so that the excited state of said pulse motor at the end of horizontal feeding motion of said feed member becomes a second predetermined specific excited state into which said pulse motor is excited while said pulse motor rotates by an angular amount P·S/2 from a specific position where said pulse motor is positioned, when said feed member is defined at the second limit position by said second stopper; and sequence setting means for moving said feed member to said second limit position so that said second excitation control means becomes operative in horizontal feeding motion at the start-up of sewing operation, and for moving said feed member to said first limit position so that said first excitation control means becomes operative in the subsequent horizontal feed motion.

* * * * *